US010954960B2

(12) United States Patent
Wang et al.

(10) Patent No.: US 10,954,960 B2
(45) Date of Patent: Mar. 23, 2021

(54) CENTRIFUGAL COMPRESSOR

(71) Applicant: IHI Corporation, Koto-ku (JP)

(72) Inventors: Baotong Wang, Koto-ku (JP); Ryusuke Numakura, Koto-ku (JP); Kenichi Nagao, Koto-ku (JP)

(73) Assignee: IHI Corporation, Koto-ku (JP)

( * ) Notice: Subject to any disclaimer, the term of this patent is extended or adjusted under 35 U.S.C. 154(b) by 211 days.

(21) Appl. No.: 16/073,738

(22) PCT Filed: Nov. 8, 2016

(86) PCT No.: PCT/JP2016/083108
§ 371 (c)(1),
(2) Date: Jul. 27, 2018

(87) PCT Pub. No.: WO2017/138199
PCT Pub. Date: Aug. 17, 2017

(65) Prior Publication Data

US 2019/0010958 A1 Jan. 10, 2019

(30) Foreign Application Priority Data

Feb. 12, 2016 (JP) ..... JP2016-024883

(51) Int. Cl.
*F04D 29/44* (2006.01)
*F04D 29/66* (2006.01)
(Continued)

(52) U.S. Cl.
CPC ..... *F04D 29/444* (2013.01); *F04D 17/10* (2013.01); *F04D 29/4213* (2013.01); *F04D 29/44* (2013.01); *F04D 29/66* (2013.01)

(58) Field of Classification Search
CPC ..... F04D 29/444; F04D 29/66; F04D 29/44; F04D 17/10; F04D 29/4213
See application file for complete search history.

(56) References Cited

U.S. PATENT DOCUMENTS 3,006,603 A * 10/1961 Caruso ..... F04D 29/444 415/195
5,165,849 A * 11/1992 Nakagawa ..... F04D 29/462 415/148

(Continued)

FOREIGN PATENT DOCUMENTS

CN 101560987 A 10/2009
CN 104053911 A 9/2014

(Continued)

OTHER PUBLICATIONS

International Search Report dated Jan. 31, 2017 in PCT/JP2016/083108.

*Primary Examiner* — Kenneth Bomberg
*Assistant Examiner* — Adam W Brown
(74) *Attorney, Agent, or Firm* — Oblon, McClelland, Maier & Neustadt, L.L.P.

(57) ABSTRACT

A centrifugal compressor is equipped with a housing including a suction passage which accommodates an impeller. The suction passage is provided with a first opening portion formed at a position facing the impeller, a second opening portion formed on an upstream side of the first opening portion, a circulation flow path which allows the first opening portion and the second opening portion to communicate with each other and extends in an annular shape around a rotational axis of the impeller, and a plurality of guide vanes disposed in the circulation flow path. The circulation flow path includes a first region in which a plurality of guide vanes is disposed at intervals in a circumferential direction, and a second region in which no guide vane is disposed. The second region extends over a wider range in the circumferential direction than the interval between the guide vanes in the first region.

8 Claims, 7 Drawing Sheets

(51) Int. Cl.
*F04D 17/10* (2006.01)
*F04D 29/42* (2006.01)

(56) References Cited

U.S. PATENT DOCUMENTS

| | | | | |
|---|---|---|---|---|
| 5,310,309 | A * | 5/1994 | Terasaki | F04D 29/444 415/208.3 |
| 7,097,411 | B2 * | 8/2006 | Smoke | F01D 9/026 415/1 |
| 7,845,900 | B2 * | 12/2010 | Roduner | F01D 9/02 415/127 |
| 8,657,558 | B2 * | 2/2014 | June | F04D 29/422 415/1 |
| 9,551,354 | B2 * | 1/2017 | Lee | F04D 5/008 |
| 2001/0028839 | A1 | 10/2001 | Nakao | |
| 2002/0106274 | A1 | 8/2002 | Sumser et al. | |
| 2005/0002782 | A1 | 1/2005 | Nikpour et al. | |
| 2006/0078423 | A1 * | 4/2006 | Zheng | F04D 17/04 415/206 |
| 2007/0217902 | A1 | 9/2007 | Sirakov et al. | |
| 2009/0263234 | A1 | 10/2009 | Yin | |
| 2010/0143111 | A1 | 6/2010 | Kuehnel | |
| 2013/0039769 | A1 * | 2/2013 | Giannozzi | F04D 29/026 416/186 R |
| 2014/0093407 | A1 * | 4/2014 | Calkins | C08F 8/44 417/405 |
| 2015/0056062 | A1 | 2/2015 | Tamaki | |
| 2015/0192147 | A1 | 7/2015 | An et al. | |
| 2015/0337863 | A1 | 11/2015 | Tomita et al. | |
| 2016/0201693 | A1 | 7/2016 | An et al. | |

FOREIGN PATENT DOCUMENTS

| | | | |
|---|---|---|---|
| CN | 104428539 | A | 3/2015 |
| CN | 105026769 | A | 11/2015 |
| EP | 2 803 866 | A1 | 11/2014 |
| GB | 1040385 | A | 8/1966 |
| JP | 5-99199 | A | 4/1993 |
| JP | 2000-87899 | A | 3/2000 |
| JP | 2001-289197 | A | 10/2001 |
| JP | 2003-106299 | A | 4/2003 |
| JP | 2003-314496 | A | 11/2003 |
| JP | 2004-144029 | A | 5/2004 |
| JP | 2004-332733 | A | 11/2004 |
| JP | 2010-65669 | A | 3/2010 |
| JP | 2010-151128 | A | 7/2010 |
| JP | 2010-168916 | A | 8/2010 |
| JP | 2012-149619 | A | 8/2012 |
| JP | 2013-148053 | A | 8/2013 |
| JP | 2014-109214 | A | 6/2014 |
| JP | 2015-86805 | A | 5/2015 |
| WO | WO 2015/001644 | A1 | 1/2015 |

* cited by examiner

CENTRIFUGAL COMPRESSOR

TECHNICAL FIELD

The present disclosure relates to a centrifugal compressor.

BACKGROUND ART in related art, a centrifugal compressor that suppresses occurrence of surging during low flow rate operation has been known. For example, the centrifugal compressor disclosed in Patent Literature 1 includes an annular treatment cavity portion (circulation flow path) in a shroud wall forming an intake port. A plurality of baffle plates is disposed at equal intervals in the treatment cavity portion.

CITATION LIST

Patent Literature

Patent Literature 1: Japanese Unexamined Patent Publication No. 2001-289197

SUMMARY OF INVENTION

Technical Problem

Generally, at an impeller outlet side of the centrifugal compressor, a non-uniform static pressure distribution in a circumferential direction is formed due to the non-axisymmetric nature of a scroll at a non-design point. In a case where the non-uniform static pressure distribution is formed, there is a risk of a difficulty in expansion of an operation range toward the low flow rate side due to the occurrence of surging. In a case where a circulation path is formed as in the centrifugal compressor disclosed in Patent Literature 1, since the flow rate to the impeller is increased by the fluid passing through the circulation path, and the operation of the centrifugal compressor is stabilized, occurrence of surging is suppressed. However, since such a centrifugal compressor is also affected by the non-uniform static pressure distribution on the impeller outlet side, there is a risk of a difficulty in expansion of the operation range toward the low flow rate side.

The present disclosure describes a centrifugal compressor capable of expanding the operation range to the low flow rate side.

Solution to Problem

A centrifugal compressor of an aspect is equipped with a housing including a suction passage which accommodates an impeller. The suction passage is provided with a first opening portion formed at a position facing the impeller, a second opening portion formed on an upstream side of the first opening portion, a circulation flow path which allows the first opening portion and the second opening portion to communicate with each other and extends in an annular shape around a rotational axis of the impeller, and a plurality of guide vanes disposed in the circulation flow path. The circulation flow path includes a first region in which a plurality of guide vanes is disposed at intervals in a circumferential direction, and a second region in which no guide vane is disposed, and the second region extends over a wider range in the circumferential direction than the interval between the guide vanes in the first region.

Effects of Invention

According to the centrifugal compressor according to the present disclosure, it is possible to expand the operation range to the low flow rate side.

DESCRIPTION OF EMBODIMENTS

Figure 1:
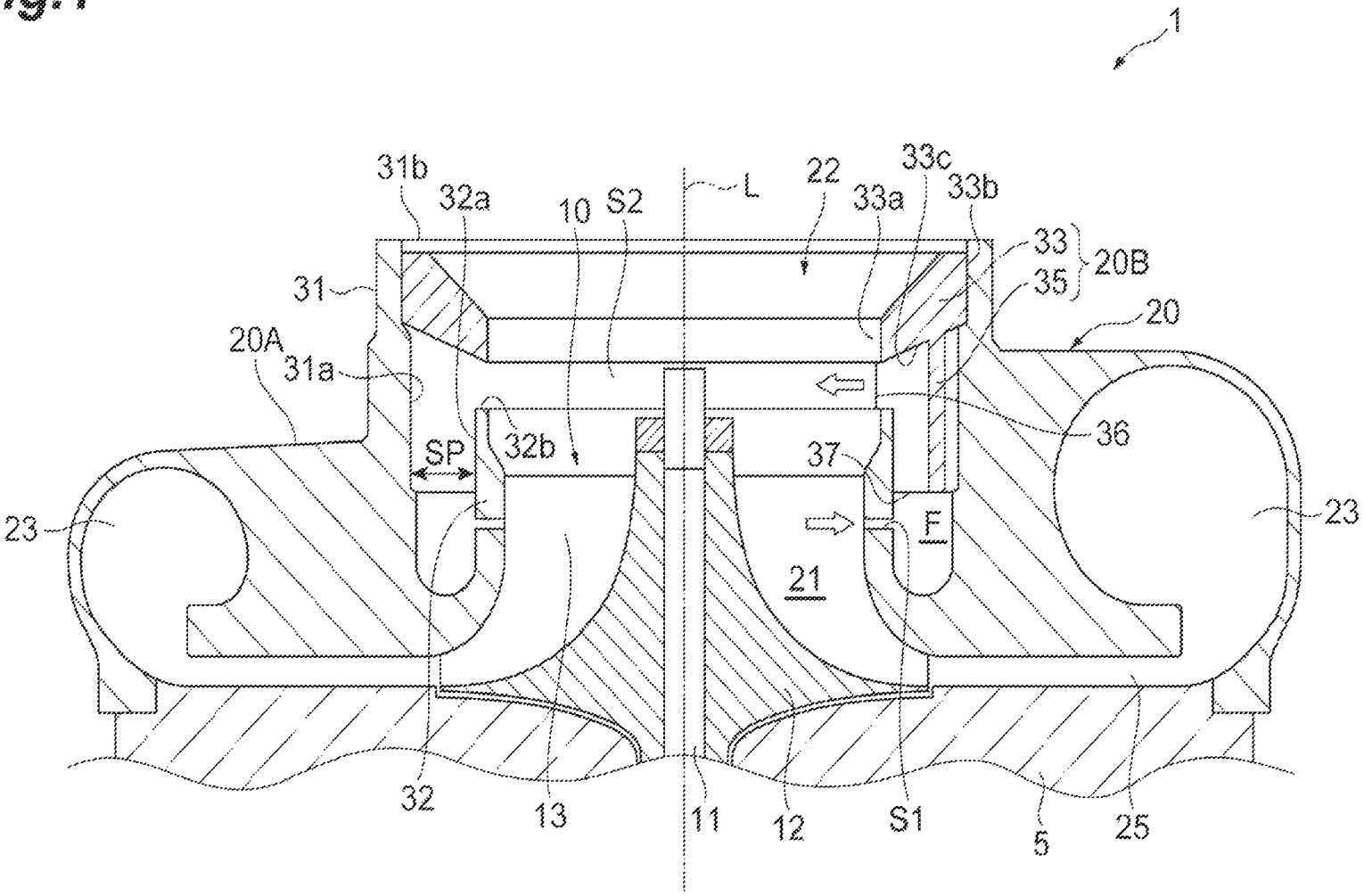
FIG. 1 is a cross-sectional view of a centrifugal compressor according to an embodiment.

A centrifugal compressor of an aspect includes a housing including a suction passage which accommodates an impeller, and the suction passage is provided with a first opening portion formed at a position facing the impeller, a second opening portion formed on an upstream side of the first opening portion, a circulation flow path which allows the first opening portion and the second opening portion to communicate with each other and extends in an annular shape around a rotational axis of the impeller, and a plurality of guide vanes disposed in the circulation flow path. The circulation flow path includes a first region in which a plurality of guide vanes is disposed at intervals in a circumferential direction, and a second region in which the guide vane is not disposed, and the second region extends over a wider range in the circumferential direction than the interval between the guide vanes in the first region.

According to this centrifugal compressor, the fluid flowing into the circulation path from the first opening portion flows out of the second opening portion toward the impeller. Since a first region and a second region are formed in the circulation path, the guide vanes in the circulation path are unevenly distributed in the circumferential direction. As a result, the fluid flowing out of the second opening portion is in a non-uniform state in the circumferential direction. Therefore, since the inflow condition into the impeller changes in the circumferential direction, the static pressure distribution on the impeller outlet side can be improved. Therefore, it is possible to expand the operation range to the low flow rate side.

Further, the housing may include an annular scroll flow path formed on an outer circumference of the impeller, and a discharge path communicating with the scroll flow path, and the first region may be formed in an angular range of ±90° on the basis of a connecting portion between the scroll flow path and the discharge path around the rotational axis of the impeller. Further, the connecting portion between the scroll flow path and the discharge path may be included in the angular range in which the first region is formed when centered on the rotational axis. According to such a configuration, since the first region is formed on the side of the connecting portion between the scroll flow path and the discharge port, the static pressure distribution of the impeller outlet on the connecting portion side is made uniform in the circumferential direction.

Further, the guide vane formed in the first region may be inclined in a direction in which the fluid is discharged in a direction opposite to a rotational direction of the impeller. In this configuration, at a position where the first region is formed, the fluid flowing out of the second opening flows in a direction opposite to the rotational direction of the impeller. Therefore, it is possible to raise the lift (head, loading) of the impeller at that position.

Also, the housing may include an insert ring which is mounted on the suction passage and forms a second opening portion, and the insert ring may include a guide vane. According to this configuration, it is possible to easily manufacture a circulation path provided with the guide vanes.

Further a centrifugal compressor according to an aspect includes a housing including a suction passage which accommodates an impeller. The suction passage is provided with a first opening portion formed at a position facing the impeller, a second opening portion formed on an upstream side of the first opening portion, a circulation flow path which allows the first opening portion and the second opening portion to communicate with each other and extends in an annular shape around a rotational axis of the impeller, and a plurality of guide vanes disposed in the circulation flow path to be spaced apart from each other in the circumferential direction. The plurality of guide vanes is formed in a non-axisymmetric manner about the rotational axis of the impeller so that the fluid flowing out of the second opening portion is in a non-uniform state in the circumferential direction, and plurality of guide vanes makes a static pressure distribution at the outlet side of the impeller uniform.

According to this centrifugal compressor, the fluid flowing into the circulation path from the first opening portion flows out of the second opening portion toward the impeller. In the circulation path, a plurality of guide vanes is disposed so as to be non-axisymmetric about the rotational axis of the impeller. Accordingly, the fluid flowing out of the second opening portion is in a non-uniform state in the circumferential direction. Therefore, since the inflow condition into the impeller changes in the circumferential direction, the static pressure distribution on the impeller outlet side can be improved. Therefore, it is possible to expand the operation range to the low flow rate side.

Hereinafter, embodiments of the present disclosure will be specifically described with reference to the drawings. For the sake of convenience, in some cases, substantially the same elements are denoted by the same reference numerals, and the description thereof will not be provided. In the following description, in the case of "upstream" or "downstream", a flow direction of a main stream traveling from a suction passage to a scroll flow path rather than a flow direction of the circulation flow flowing through the circulation flow path is used as a reference.

FIG. 1 is a cross-sectional view of a centrifugal compressor. As illustrated in FIG. 1, a centrifugal compressor 1 includes an impeller 10, and a housing 20 that accommodates the impeller 10. The impeller 10 includes a hub 12 attached to a rotational axis 11 and rotating around a rotational axis L, and a plurality of blades 13 disposed on an outer circumferential surface of the hub 12 along the circumferential direction of rotation. The rotational axis 11 is attached to a bearing housing 5 fixed to the housing 20 in a freely rotatable manner. The hub 12 has a shape having a small diameter toward a distal end side, and has an outer side surface that is curved while being convex on the rotational axis L side. The blades 13 are arranged on the outer circumferential surface of the hub 12 at equal intervals in the circumferential direction of rotation.

The housing 20 includes a housing body 20A and an insert ring 20B. The housing body 20A includes an annular scroll flow path 23 and a discharge portion (discharge path) 24 (see FIG. 3), and includes a cylindrical outer wall portion 31 provided at the center of the scroll flow path 23. The outer wall portion 31 protrudes toward the upstream side in the housing body 20A with a downstream side as a proximal end. A cylindrical inner wall portion 32 is formed inside the outer wall portion 31. The inner wall portion 32 rises toward the upstream side with the downstream side of the outer wall portion 31 as a proximal end. That is, the inner wall portion 32 and the outer wall portion 31 are continuously formed on the downstream side, and the continuous portion is a shroud portion opposite to the blade 13. The inner circumferential side of the outer wall portion 31 and the inner wall portion 32 is a suction passage 22. A space of the suction passage 22 inside the inner wall portion 32 is an accommodation portion 21, and accommodates the impeller 10 in a freely rotatable manner. That is, the inner circumferential surface of the inner wall portion 32 faces the blade 13 of the impeller 10.

An end portion 32*b* of the inner wall portion 32 on the upstream side is located on the downstream side of the end portion 31*b* of the outer wall portion 31 on the upstream side. Further, a gap SP is formed between the inner wall portion 32 and the outer wall portion 31 in a radial direction. Further, a circumferential slit (first opening portion) S1 around the rotational axis L is formed in the inner wall portion 32. The slit S1 is provided at a position facing the blade 13 in the axial direction. As a result, the accommodation portion 21 and the gap SP communicate with each other through the slit S1.

Figure 2:
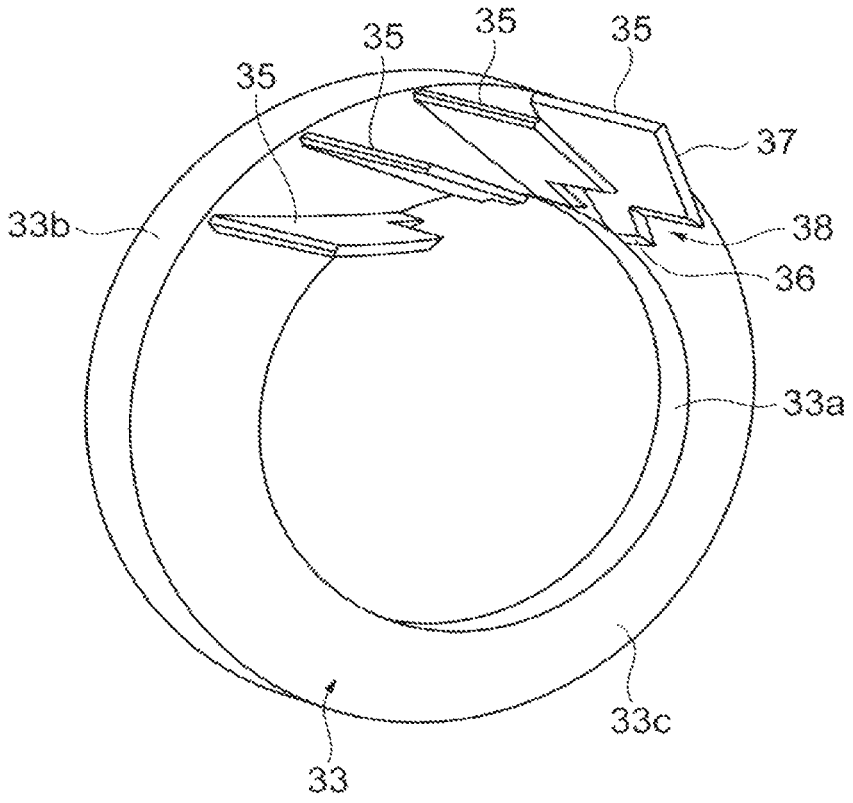
FIG. 2 is a perspective view illustrating an insert ring.

The insert ring 20B forms a part of a casing treatment structure. FIG. 2 is a perspective view illustrating the insert ring 20B. As illustrated in FIGS. 1 and 2, the insert ring 20B is fixed to the inside of the outer wall portion 31 of the housing body 20A. The insert ring 20B includes an annular plate-like base portion 33, and a plurality of guide vanes 35 fixed to the base portion 33. The outer diameter of the base portion 33 is, for example, substantially the same as the inner diameter of the outer wall portion 31 on the upstream side. Further, the inner diameter of the base portion 33 is, for example, substantially the same as the inner diameter of the inner wall portion 32 on the upstream side. The base portion 33 is inclined, for example, toward the downstream side from the outer circumferential side to the inner circumferential side. That is, the inner side surface 33*a* of the base portion 33 is located on the downstream side of the outer side surface 33*b* of the base portion 33. A surface (bottom surface 33*c*) of the base portion 33 on the downstream side is disposed to be further spaced apart from the end portion 32*b* on the upstream side of the inner wall portion 32 to the upstream side. Thus, a circumferential slit (second opening portion) S2 around the rotational axis L is formed between the base portion 33 and the inner wall portion 32. In the present embodiment, an annular circulation flow path F is formed by the slit S1 formed in the inner wall portion 32, the gap SP between the inner wall portion 32 and the outer wall portion 31, and the slit S2 between the inner wall portion 32 and the base portion 33. A part of the air flowing in from the suction passage 22 flows into the circulation flow path F from the accommodation portion 21 via the slit S1. Further, this part of the air returns to the suction passage 22 again via the slit S2 and goes to the downstream. In this way, the circulation flow path F allows the slit S1 and the slit S2 to communicate with each other, and extends in an annular shape around the rotational axis L.

The guide vane 35 has a plate shape and is erected on the bottom surface 33*c* of the base portion 33. As a result, the guide vane 35 is disposed in the circulation flow path F. The guide vane 35 in the present embodiment is disposed in parallel with the rotational axis L. Further, the guide vane 35 is disposed to be inclined with respect to the radial direction. For example, the guide vane 35 is inclined in a direction in which air (fluid) is discharged in a direction opposite to the rotational direction of the impeller 10 (although it is not illustrated in FIG. 3, the impeller 10 rotates clockwise as viewed from the front of the housing 20).

The base portion 33 side of the guide vane 35 extends from the end edge on the inner side surface 33*a* side of the base portion 33 to the end edge on the outer side surface 33*b* side. Further, on the base portion 33 side of the guide vane 35, an inner end edge 36 thereof is located between the base portion 33 and the inner wall portion 32 (that is, the slit S2). On the distal end 37 side of the guide vane 35, a notched portion 38 is formed on the inner side in the radial direction so as to fit into the circulation flow path F, and the distal end 37 side has a narrower width than the base portion 33 side. In a state in which the insert ring 20B is fixed to the housing body 20A, the distal end 37 side of the guide vane 35 extends from the outer circumferential surface 32*a* of the inner wall portion 32 to the inner circumferential surface 31*a* of the outer wall portion 31. In the direction of the rotational axis L, the position of the distal end 37 of the guide vane 35 is located on the side closer to the base portion 33 than the position of the slit S1.

Figure 3:
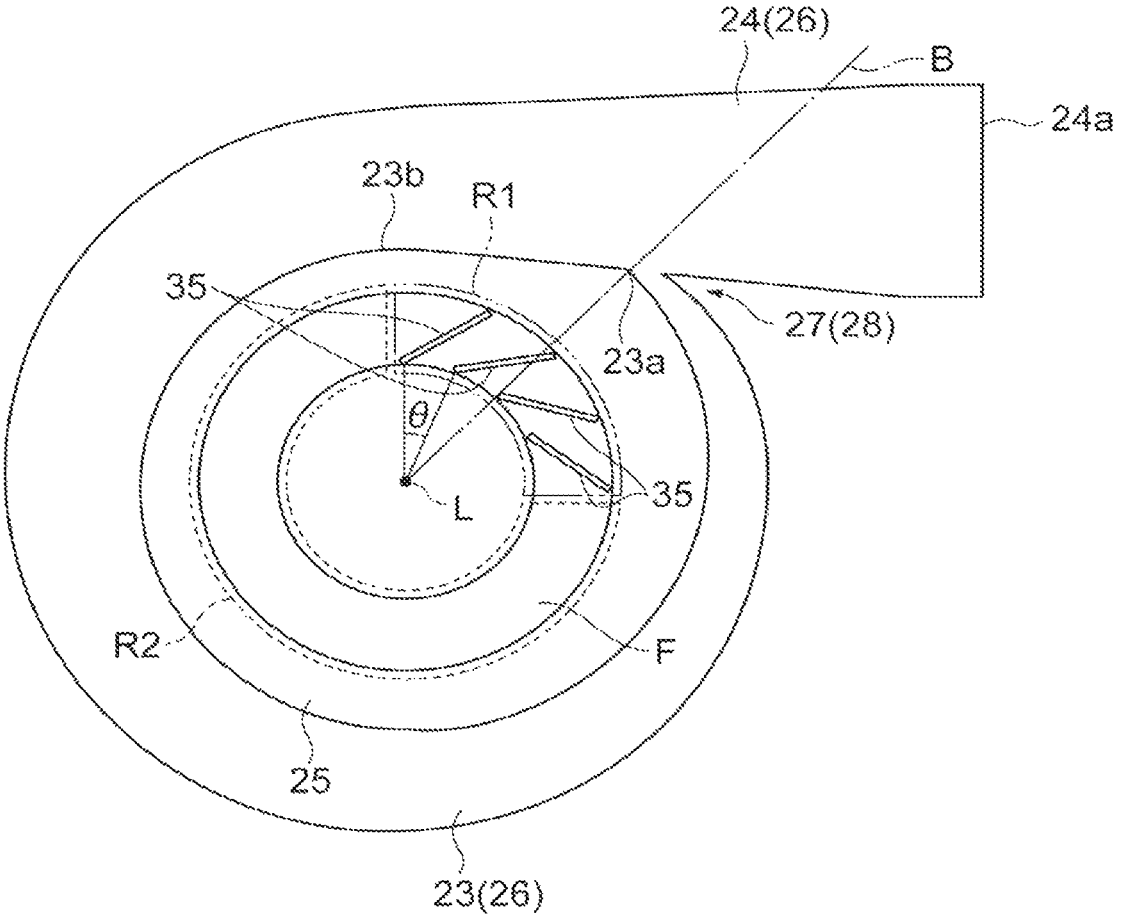
FIG. 3 is a schematic diagram illustrating the arrangement of a guide vane.

The arrangement of the plurality of guide vanes 35 will be described with reference to FIG. 3. FIG. 3 is a schematic diagram illustrating the arrangement of the guide vanes 35 in the circulation flow path F. As illustrated in FIG. 3, a scroll flow path 26 is formed by the scroll flow path 23 and the discharge portion 24. The air sent by the impeller 10 is collected in the scroll flow path 26 via the diffuser 25, and is discharged from the discharge port 24*a* formed in the discharge portion 24. The diffuser 25 is an annular parallel flow path having a constant height in the direction of the rotational axis L. The diffuser 25 is provided between the accommodation portion 21 in which the impeller 10 is disposed and the scroll flow path 26 to allow the accommodation portion 21 and the scroll flow path 26 to communicate with each other.

A tongue portion 28 is provided in a connecting portion 27 between the scroll flow path 23 and the discharge portion 24. The scroll flow path 23 in the scroll flow path 26 extends from a scroll start portion 23*a* corresponding to the tongue portion 28 to a scroll finish portion 23*b*. More specifically, the angle in the circumferential direction from the scroll start portion 23*a* to the scroll finish portion 23*b* is, for example, about 320°. The present invention is not limited to this embodiment, and the angle in the circumferential direction from the scroll start portion 23*a* to the scroll finish portion 23*b* may be less than 320° or may be 320° or more. For example, the scroll flow path 23 may be continuous over one cycle (that is, 360°).

In the present embodiment, a plurality of guide vanes 35 is disposed at intervals in the circumferential direction. These guide vanes 35 are disposed in a partial range of the base portion 33 in the circumferential direction. Accordingly, the circulation flow path F includes a first region R1 in which the plurality of guide vanes 35 is disposed in the circumferential direction, and the second region R2 in which the guide vane 35 is not disposed. The second region R2 extends over a wider range in the circumferential direction than the interval between the guide vanes 35 in the first region R1. In the present embodiment, the first region R1 in which the guide vanes 35 are formed is a region having a central angle of about 90° around the rotational axis L in the annular circulation flow path F. In the first region R1, the plurality of guide vanes 35 is disposed at equal intervals with, for example, a pitch angle θ of about 20° to 30°. In the illustrated example, the pitch angle θ of the guide vanes 35 is about 22.5°. On the other hand, the second region R2 is a region in which the guide vane 35 is not formed, and is a region having a central angle of about 270° around the rotational axis L in the annular circulation flow path F.

Further, in the present embodiment, the first region R1 is formed in an angular range of ±90° on the basis of the connecting portion 27 (tongue portion 28) between the scroll flow path 23 and the discharge portion 24 around the rotational axis L. In the example illustrated in FIG. 3, the connecting portion 27 between the scroll flow path 23 and the discharge portion 24 is included in the angular range in which the first region R1 is formed. More specifically, the center of the first region R1 in the circumferential direction around the rotational axis L substantially coincides with the position of the connecting portion 27. Further, in this example, the angular position of the one end portion of the first region R1 in the circumferential direction substantially coincides with the position of the scroll finish portion 23*b* of the scroll flow path 23.

Figure 4:
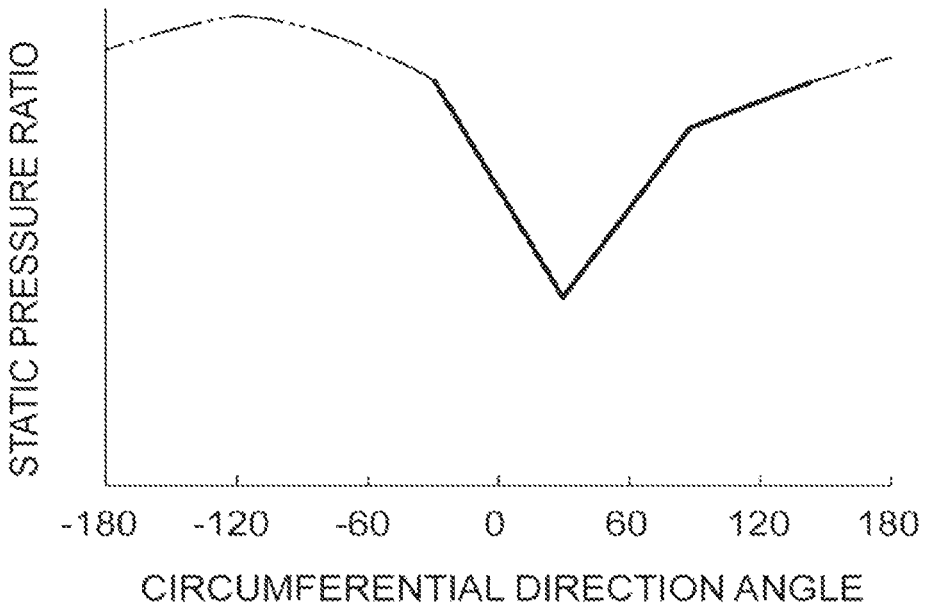
FIG. 4 is a diagram illustrating a pressure distribution in a circumferential direction on an outlet side of an impeller.

Next, the operation and effect of the centrifugal compressor 1 in the present embodiment will be described. FIG. 4 illustrates an example of a static pressure distribution on the outlet side of the impeller 10 in a case where the second region R2 is not formed (that is, a case where the guide vanes 35 are arranged in the circulation flow path F at regular intervals in the entire circumferential direction, and this is hereinafter referred to as "ordinary product"). The angle in the circumferential direction on the horizontal axis is an angle around the rotational axis L, and the position of the tongue portion 28 is used as a reference B (that is, 0°, see FIG. 3). Further, a direction of flow in the scroll flow path 26 (a clockwise direction in FIG. 3) is set as +, and a direction opposite to the flow in the scroll flow path 26 (a counterclockwise direction in FIG. 3) is set as −. In this static pressure distribution, the pressure ratio falls within the range of about ±90°, and the static pressure ratio (outlet side pressure/inlet side pressure of the impeller 10) is the minimum at the position of 30°. Normally, the position of the tongue portion 28 has the minimum static pressure ratio, but since the pressure propagation path is different depending on the shape of the casing or the like, the position of the tongue portion 28 does not always coincide with the position of the minimum static pressure ratio. However, since the position of the tongue portion 28 is relevant to the minimum static pressure ratio, the position having the minimum static pressure ratio with respect to the position of the tongue portion 28 is often present in the range of ±30°. In this way, in the case of ordinary products, when a non-uniform static pressure distribution is formed in the circumferential direction, in some cases, it is difficult to expand the operation range toward the low flow rate side due to the occurrence of surging.

Figure 5:
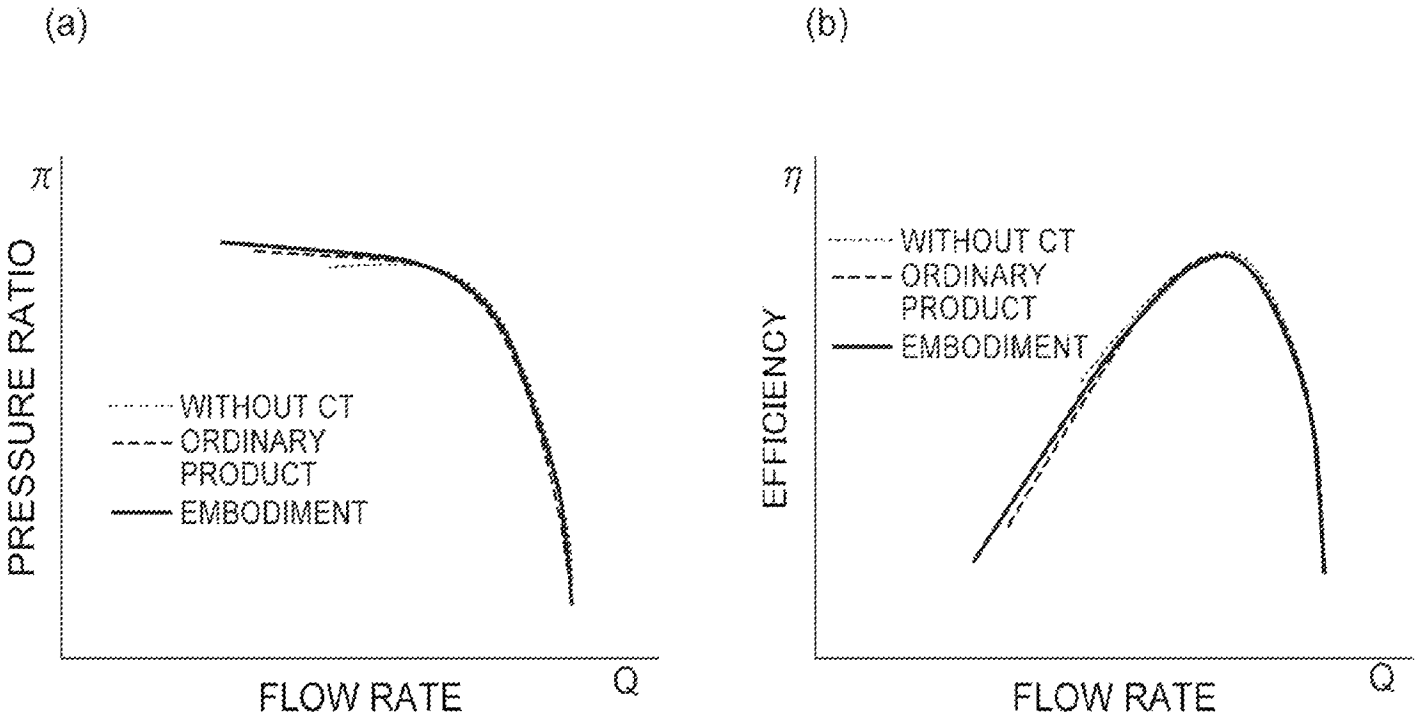
FIG. 5(*a*) is a diagram illustrating a relation between the flow rate and the pressure ratio, and FIG. 5(*b*) is a diagram illustrating a relation between the flow rate and the compressor efficiency.

FIG. 5(*a*) is a diagram illustrating a relation between a flow rate (Q) and a pressure ratio (π), and FIG. 5(*b*) is a diagram illustrating a relation between the flow rate (Q) and a compressor efficiency (η). Both the pressure ratio and the compressor efficiency are an example of performance prediction results obtained by a computational fluid dynamics (CFD) analysis. In FIGS. 5(*a*) and 5(*b*) an example having no casing treatment shape (without CT), and an example of the performance prediction result of an ordinary product are set as a comparative example. In each of the results of the pressure ratio and the compressor efficiency, in the present embodiment, the performance prediction result is obtained in a wider range on the low flow rate side than the comparative example. That is, in this embodiment, it is considered that the operation range is expanded on the low flow rate side. Further, in both the performance prediction results of the pressure ratio and the compressor efficiency, the graph of the present embodiment exceeds the graph of the ordinary product on the low flow rate side. That is, in this embodiment, it is considered that the efficiency of the compressor is improved as compared with the ordinary product.

In this way, according to the centrifugal compressor 1 of the present embodiment, the air flowing into the circulation flow path F from the slit S1 flows out of the slit toward the impeller 10. Since the first region R1 and the second region R2 are formed in the circulation flow path F, the guide vanes 35 in the circulation flow path F are unevenly distributed in the circumferential direction. As a result, the fluid flowing out of the slit S2 is in a non-uniform state in the circumferential direction. Therefore, since the inflow condition to the impeller 10 changes in the circumferential direction, it is possible to improve the static pressure distribution in the diffuser 25 which is the outlet side of the impeller 10. Therefore, it is possible to expand the operation range to the low flow rate side.

Further, the first region R1 is formed in an angular range of ±90° on the basis of the tongue portion 28 which is the connecting portion 27 between the scroll flow path 23 and the discharge portion 24 around the rotational axis L of the impeller 10. In particular, the tongue portion 28 is included in the angular range in which the first region R1 is formed when centered on the rotational axis L. Since the first region R1 is formed on the tongue portion 28 side in this way, it is possible to improve the uniformity of the static pressure distribution of the impeller outlet on the tongue portion 28 side in which the static pressure ratio tends to decrease.

Further, the guide vane 35 formed in the first region R1 is inclined in a direction in which the fluid is discharged in a direction opposite to the rotational direction of the impeller 10. In this configuration, at the position where the first region R1 is formed, the air flowing out of the slit S2 flows in a direction opposite to the rotational direction of the impeller 10. Therefore, it is possible to raise lift (head, loading) of the impeller 10 at this position. Therefore, the work of the impeller 10 rises as compared with the position where the second region R2 is formed, and it is possible to improve the static pressure distribution on the outlet side of the impeller 10.

Further, the housing 20 includes an insert ring 20B which is mounted in the suction passage 22 and forms the slit S2. A guide vane 35 is provided in the insert ring 20B. According to such a configuration, it is possible to easily manufacture the circulation flow path F including the guide vane 35.

Although the embodiment of the present disclosure has been described in detail with reference to the drawings, the specific configuration is not limited to this embodiment. For example, FIGS. 6(*a*) to 6(*i*) illustrate the form of a guide vane according to a modified example. In the modified example, only the form of the guide vane differs from the above embodiment. Hereinafter, differences from the embodiment will be mainly described, and the same elements and members are denoted by the same reference numerals, and the detailed description thereof will not be provided. The basic shape of the guide vane in each modified example is the same as that of the guide vane 35 of the embodiment, unless otherwise mentioned. Further, the "slope" of the guide vane is based on the radial direction around the rotational axis L.

Figure 6:
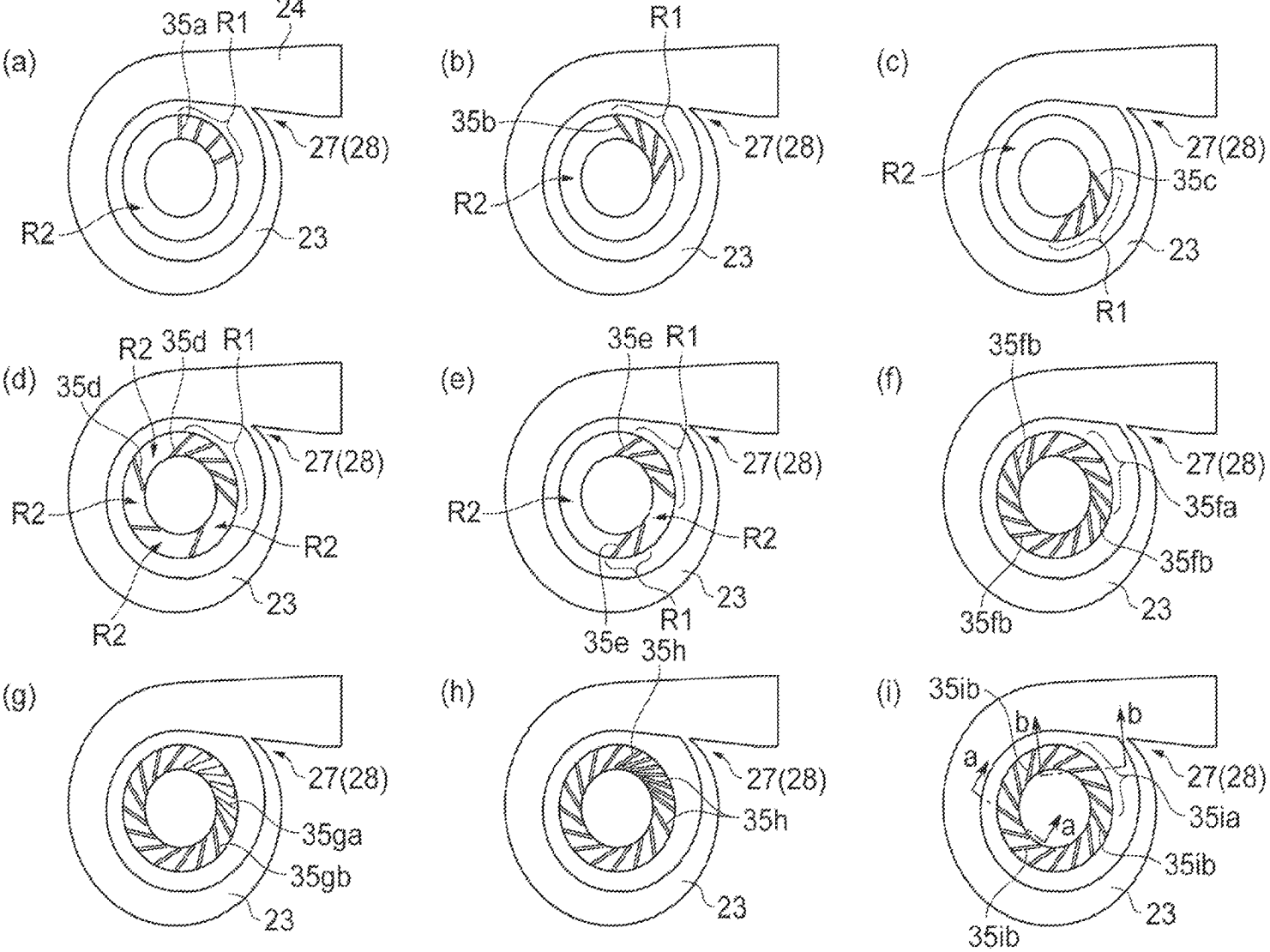
FIGS. 6(*a*) to 6(*i*) are schematic diagrams describing a form of the guide vane in a centrifugal compressor according to a modified example.

In this embodiment, as an example in which the guide vanes 35 are disposed to be inclined with respect to the radial direction, an example is illustrated in which the guide vanes 35 are inclined in a direction in which the air is discharged in the direction opposite to the rotational direction of the impeller 10. However, the embodiment is not limited thereto. For example, as illustrated in FIG. 6(*a*), the guide vanes 35*a* may be disposed to extend in the radial direction. Further, as illustrated in FIG. 6(*b*), the guide vanes 35*b* may be inclined to discharge air in the rotational direction of the impeller 10.

Further, in the embodiment, an example in which the center of the first region R1 in the circumferential direction around the rotational axis L substantially coincides with the position of the tongue portion 28 is illustrated, but the present invention is not limited thereto. The first region R1 may be formed at any position in the circumferential direction. For example, as illustrated in FIG. 6(*c*), the tongue portion 28 may not be included in the angular range in which the first region R1 is formed. In this example, a part of the first region R1 overlaps the angular range of ±90° on the basis of the tongue portion 28.

Further, in the embodiment, the example in which the second region R2 is formed only partly is illustrated, but the present invention is not limited thereto. For example, as illustrated in FIG. 6(*d*), the second region R2 may be divided by the guide vane 35*d*. In this example, since three guide vanes 35*d* are disposed in a region (a second region R2 in the embodiment) other than the first region R1, four second regions R2 are provided. Each of the second regions R2 extends over a wider range in the circumferential direction than the interval of the guide vanes 35*d* in the first region R1.

Further, in the embodiment, the example in which the first region R1 is formed only partially is illustrated, but the present invention is not limited thereto. A plurality of the first regions R1 may be formed. For example, as illustrated in FIG. 6(*e*), another first region R1 may be formed at a position spaced apart from the first region R1 in the circumferential direction. In this case, the region between the first region R1 and another first region R1 is the second region R2. That is, the second regions R2 are formed in two places. In the illustrated example, the numbers of the guide vanes 35*e* in the two first regions R1 are different, but the number of the guide vanes 35*e* may be the same.

Further, in the embodiment, the example in which the air flowing out of the slit S2 is made non-uniform in the circumferential direction by forming the first region R1 and the second region R2 is illustrated, but the present invention is not limited thereto. That is, a plurality of guide vanes may be formed all over the circumferential direction. The guide vanes are formed in a non-axisymmetric manner around the rotational axis 11 of the impeller 10 so that the air flowing out of the slit S2 is in a non-uniform state in the circumferential direction. As a result, the static pressure distribution on the outlet side of the impeller 10 is made uniform. An example of such a form will be described with reference to FIGS. 6(*f*) to 6(*i*).

For example, in the example illustrated in FIG. 6(*f*), the form of the guide vane in a part of the guide vanes arranged over the entire circumferential direction is different from the form of other guide vanes. For example, the slope (the guide vanes of the illustrated example are inclined with the clockwise direction as the + direction) of the plurality (four in the illustrated example) of the guide vanes 35*fa* facing the tongue portion 28 side with respect to the radial direction is greater than the slope of the slope of the other guide vane 35*fb*. As a result, a throat width of the guide vane 35*fa* is smaller than a throat width of the other guide vane 35*fb*. In this case, since the throat width (the shortest interval between the adjacent guide vanes) of the guide vanes changes in the circumferential direction, the air flowing out of the slit S2 is in a non-uniform state in the circumferential direction. Therefore, since the inflow condition to the impeller 10 changes in the circumferential direction, the static pressure distribution on the outlet side of the impeller 10 can be improved. Therefore, it is possible to expand the operation range to the low flow rate side.

Also, as illustrated in FIG. 6(*g*), the shape of some of the guide vanes among the guide vanes arranged over the entire circumferential direction may be different. In this example, the slope of one side surface of the plurality (four in the illustrated example) of the guide vanes 35*ga* facing the tongue portion 28 side is greater than one side surface of the other guide vane 35*gb*. Even in this case, as in the example of FIG. 6(*f*), the throat width between the guide vanes 35*ga* is smaller than the throat width between other guide vanes 35*gb*.

Further, as illustrated in FIG. 6(*h*), the interval between the guide vanes in a partial region of the guide vanes arranged over the entire circumferential direction may be different. In this example, the interval between the guide vanes 35*h* arranged at the position facing the tongue portion 28 is smaller than that of other guide vanes 35*h*. In this case, the throat width of the guide vanes 35*h* is smaller than the throat width of other guide vanes 35*h*.

In FIGS. 6(*f*) to 6(*h*), the example in which the throat width in a partial region is small is illustrated, but the throat width may be increased. For example, the throat width may be increased, by decreasing the slope of the guide vane with respect to the radial direction or by widening the interval between the guide vanes only in a partial region.

Figure 7:
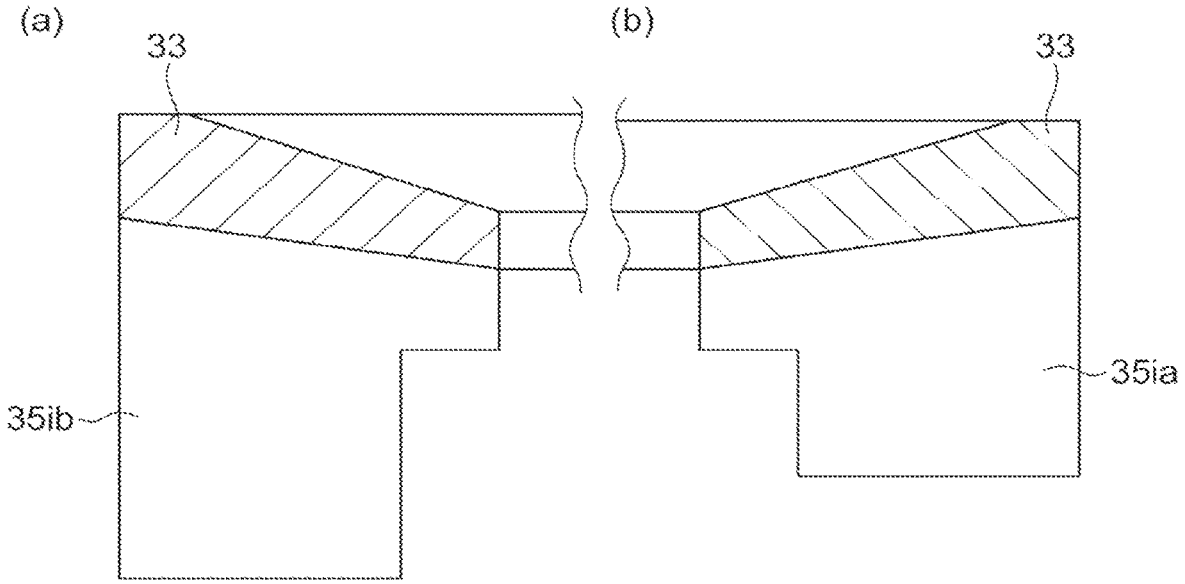
FIGS. 7(*a*) and 7(*b*) are schematic diagrams describing the form of the guide vane of FIG. 6(*i*).

Further, as illustrated in FIG. 6(*i*), only the guide vanes of a partial region among the guide vanes arranged over the entire circumferential direction may have different shapes. In this example, the shape of the guide vanes 35*ia* disposed at a position facing the tongue portion 28 is different from that of other guide vanes 35*ib*. FIG. 7(*a*) is a schematic view of the guide vane 35*ib* on the cross-section a-a of FIG. 6(*i*), and FIG. 7(*b*) is a cross-sectional view of the guide vane 35*ia* on the cross-section b-b of FIG. 6(*i*). As illustrated in FIGS. 7(*a*) and 7(*b*), the length of the guide vane 35*ia* in the direction of the rotational axis L is smaller than the length of the guide vane 35*ib* in the direction of the rotational axis L. Thus, the air flowing out of the slit S2 is in a non-uniform state in the circumferential direction.

In the above-described embodiment and modified example, the guide vanes 35 which are disposed in parallel with the rotational axis L and extend in a direction which does not intersect with the rotational axis L are illustrated, but the present invention is not limited thereto. For example, guide vanes extending in a direction inclined with respect to the rotational axis L may be used. Further, although the flat guide vane 35 is illustrated, a curved plate-like guide vane (a so-called curved blade) may be used.

Further, the example in which the guide vane 35 is provided in the insert ring 20B is illustrated, but the invention is not limited thereto. The guide vanes may be formed in the circulation flow path F formed in the suction passage 22. For example, the guide vanes may be integrally formed with the housing body.

Further, although the example in which the impeller 10 rotates clockwise as viewed from the front of the compressor housing is illustrated, the present invention is not limited thereto. The invention can be applied to a compressor in which the impeller 10 rotates counterclockwise. In this case, in accordance with the rotational direction of the impeller 10, the scroll flow path 23 of the scroll flow path 26 is connected to the discharge portion 24 so that the scroll direction from the beginning of scroll to the end of scroll turns counterclockwise.

INDUSTRIAL APPLICABILITY

According to the present disclosure, it is possible to provide a centrifugal compressor capable of enlarging an operation range to a low flow rate side.

REFERENCE SIGNS LIST

1 Centrifugal compressor
10 Impeller
11 Rotational axis
20 Housing
20A Housing body
20B Insert ring
21 Accommodation portion
22 Suction passage
23 scroll flow path
24 Discharge portion
27 Connecting portion
28 Tongue portion
35 Guide vane
F Circulation flow path
R1 First region
R2 Second region
S1 Slit (first opening portion)
S2 Slit (second opening portion

The invention claimed is:

1. A centrifugal compressor comprising a housing including an suction passage which accommodates an impeller, wherein the suction passage is provided with a first opening portion formed at a position facing the impeller, a second opening portion formed on an upstream side of the first opening portion, a circulation flow path which allows the first opening portion and the second opening portion to communicate with each other and extends in an annular shape around a rotational axis of the impeller, and a plurality of guide vanes disposed in the circulation flow path, the circulation flow path includes a first region in which a plurality of guide vanes is disposed at intervals in a circumferential direction, and a second region in which no guide vane is disposed, and the second region extends over a wider range in the circumferential direction than the interval between the guide vanes in the first region, the housing comprises an annular scroll flow path formed on an outer circumference of the impeller, and a discharge portion communicating with the scroll flow path, and the first region is formed in an angular range of ±90° on the basis of a connecting portion between the scroll flow path and the discharge portion around the rotational axis of the impeller.

2. The centrifugal compressor according to claim 1, wherein the connecting portion between the scroll flow path and the discharge portion is included in the angular range in which the first region is formed when centered on the rotational axis.

3. The centrifugal compressor according to claim 1, wherein the guide vane formed in the first region is inclined in a direction in which the fluid is discharged in a direction opposite to a rotational direction of the impeller.

4. The centrifugal compressor according to claim 2, wherein the guide vane formed in the first region is inclined in a direction in which the fluid is discharged in a direction opposite to a the rotational direction of the impeller.

5. The centrifugal compressor according to claim 1, wherein the housing comprises an insert ring which is mounted in the suction passage and forms the second opening, and the insert ring comprises the guide vane.

6. The centrifugal compressor according to claim 2, wherein the housing comprises an insert ring which is mounted in the suction passage and forms the second opening, and the insert ring comprises the guide vane.

7. The centrifugal compressor according to claim 3, wherein the housing comprises an insert ring which is mounted in the suction passage and forms the second opening, and the insert ring comprises the guide vane.

8. The centrifugal compressor according to claim 4, wherein the housing comprises an insert ring which is mounted in the suction passage and forms the second opening, and the insert ring comprises the guide vane.

* * * * *